US006190202B1

(12) United States Patent
Lai

(10) Patent No.: US 6,190,202 B1
(45) Date of Patent: Feb. 20, 2001

(54) CABLE CONNECTOR WITH SYSTEM FOR HIGH-SPEED SIGNAL TRANSMISSION

(75) Inventor: Chin-Te Lai, Tao-Yuan (TW)

(73) Assignee: Hon Hai Precision Ind. Co., Ltd., Taiepi Hsien (TW)

( * ) Notice: Under 35 U.S.C. 154(b), the term of this patent shall be extended for 0 days.

(21) Appl. No.: 09/454,181

(22) Filed: Dec. 2, 1999

(30) Foreign Application Priority Data

Nov. 11, 1999 (TW) ..... 88219278

(51) Int. Cl.[7] ..... H01R 9/05
(52) U.S. Cl. ..... 439/578; 439/579
(58) Field of Search ..... 439/580, 579, 439/578, 869

(56) References Cited

U.S. PATENT DOCUMENTS 4,708,666 * 11/1987 Fisher, Jr. ..... 439/580
5,768,771 * 6/1998 O'Sullivan et al. ..... 439/579 X
5,961,348 * 10/1999 Murphy ..... 439/579

* cited by examiner

*Primary Examiner*—Renee Luebke
(74) *Attorney, Agent, or Firm*—Wei Te Chung

(57) ABSTRACT

A cable connector having a system for high-speed signal transmission comprises an insulative housing, a plurality of data transmission terminals, and the system for high-speeding signal transmission. The system for high-speed signal transmission comprises a plurality of high-speed signal terminals, a grounding plate, an insulative spacer, and a ferrule. The insulative spacer has a front face and a rear face and defines an elongate slot extending therethrough, a pair of grooves being defined in the front face and being in communication with the slot, and a plurality of passageways being defined on opposite sides of the slot for receiving the signal terminals. The grounding plate defines a pair of teeth laterally projecting from opposite side edges thereof so that as the grounding plate is extended through the slot of the insulative spacer, the teeth fit into the grooves of the space. The ferrule clamps a plurality of metallic braids of connected coaxial cables to the grounding plate.

4 Claims, 5 Drawing Sheets

CABLE CONNECTOR WITH SYSTEM FOR HIGH-SPEED SIGNAL TRANSMISSION

BACKGROUND OF THE INVENTION

The present invention relates to a cable connector having a system for high-speed signal transmission, and particularly to a new assembly of the grounding plate and insulative spacer of the system for high-speed signal transmission.

Taiwan Patent Application Nos. 86102087; 86102088; 86102094 and 86102095 disclose cable connectors with a system for high-speed signal transmission. U.S. Pat. No. 5,768,771 as shown in FIG. 5, discloses a conventional high speed cable connector 90 which has a dielectric housing 91, two terminal blocks 93, a plurality of high speed signal terminals 94 inserted molded with the terminal blocks 93, a grounding plate 95 clamped between the terminal blocks 93, and a plurality of coaxial cables 96. The grounding plate 95 forms a plurality of wing-shaped position arms 952 at a rear end thereof. Each cable 96 has a center conductor 962 and a metallic braid 964. The center conductor 962 is soldered to an end of a corresponding terminal 94. The position arms 952 clamp the metallic braids 964 of each of the coaxial cables 96, thereby retaining the cable and transmitting electrostatic charge to ground via a mating connector (not shown) engaged with the cable connector 90. However, to manufacture a conventional high-speed cable connector by insert molding the terminals with the terminal block, all the terminals are first positioned in the molds, and then molten plastic is inserted into the molds under high pressure. Using this procedure, it is difficult to achieve a product with the terminals in the preferred position since the terminals are very thin, so production output suffers. Hence, an improved cable connector having a system for high-speed signal transmission is required to overcome the disadvantages of the prior art.

BRIEF SUMMARY OF THE INVENTION

An object of the present invention is to provide a cable connector having a system for high-speed signal transmission that is easy to manufacture and easy to assemble into the connector.

A cable connector having a system for high-speed signal transmission of the present invention comprises an insulative housing, a plurality of data transmission terminals received in one side of the insulative housing, and a system for high-speed signal transmission received in an opposite side of the insulative housing.

The system for high-speed signal transmission comprises a plurality of high-speed signal terminals, a grounding plate, an insulative spacer, and a ferrule. The insulative spacer has a front face and a rear face and defines an elongate slot extending therethrough, a pair of grooves being defined in the front face and in communication with the slot, a plurality of passageways being defined on opposite sides of the slot for receiving the signal terminals. The elongate grounding plate defines a pair of teeth laterally projecting from opposite side edges thereof, the grounding plate extending through the slot of the insulative spacer and the teeth fitting into the grooves of the insulative spacer. The ferrule clamps a plurality of metallic braids each corresponding to a coaxial cable connected to the high-speed signal terminal to the grounding plate.

Other objects, advantages and novel features of the invention will become more apparent from the following detailed description of the present embodiment when taken in conjunction with the accompanying drawings.

DETAILED DESCRIPTION OF THE INVENTION

Figure 1:
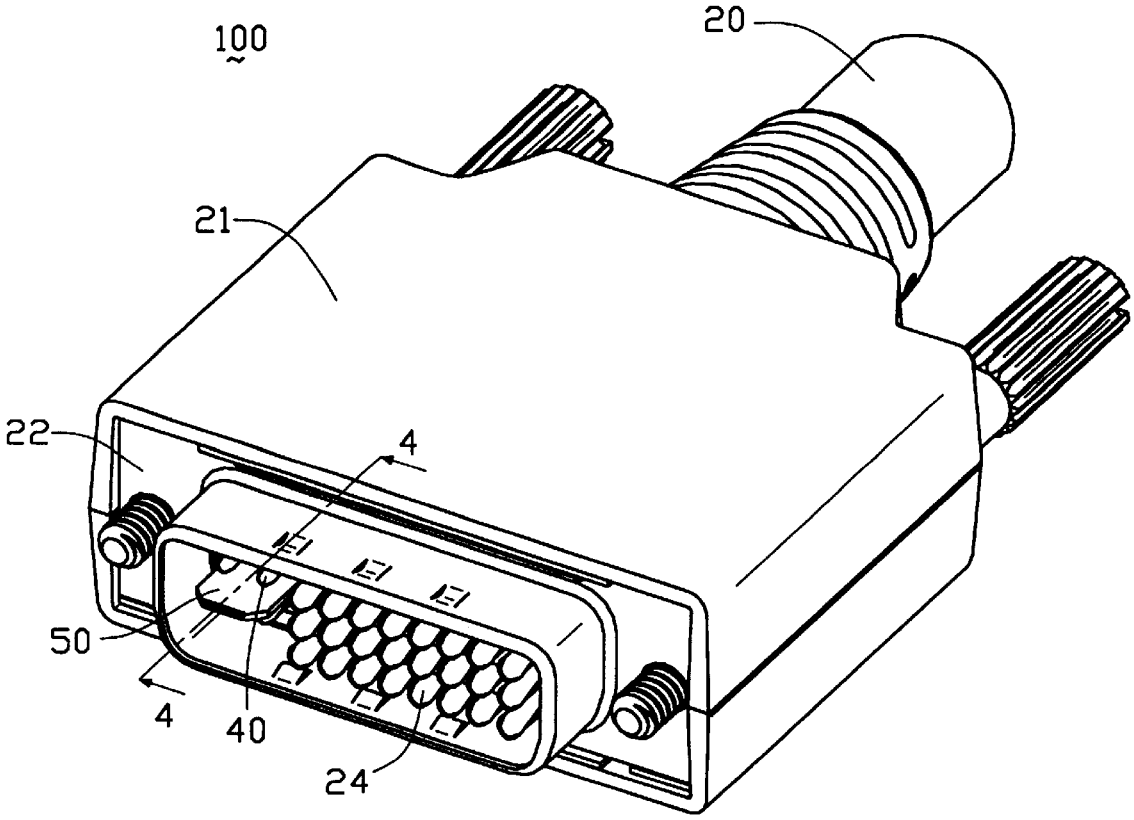
FIG. 1 is an assembled view of a cable connector of the present invention.
Figure 4:
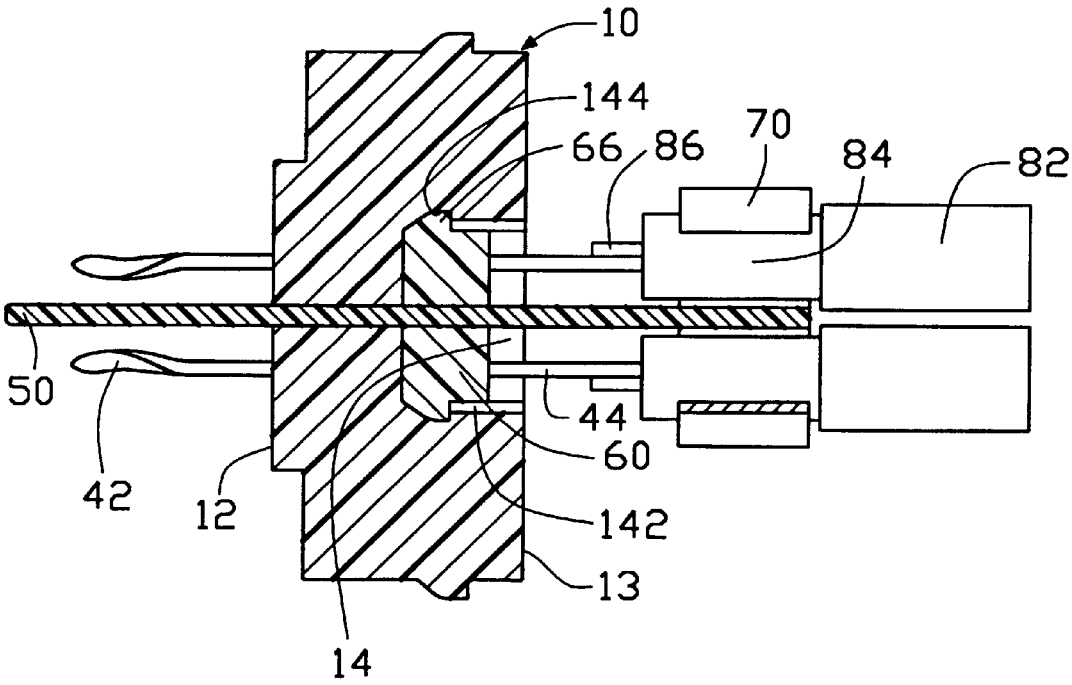
FIG. 4 is a part cross-sectional view taken from line 4—4 of FIG. 1.
Figure 5:
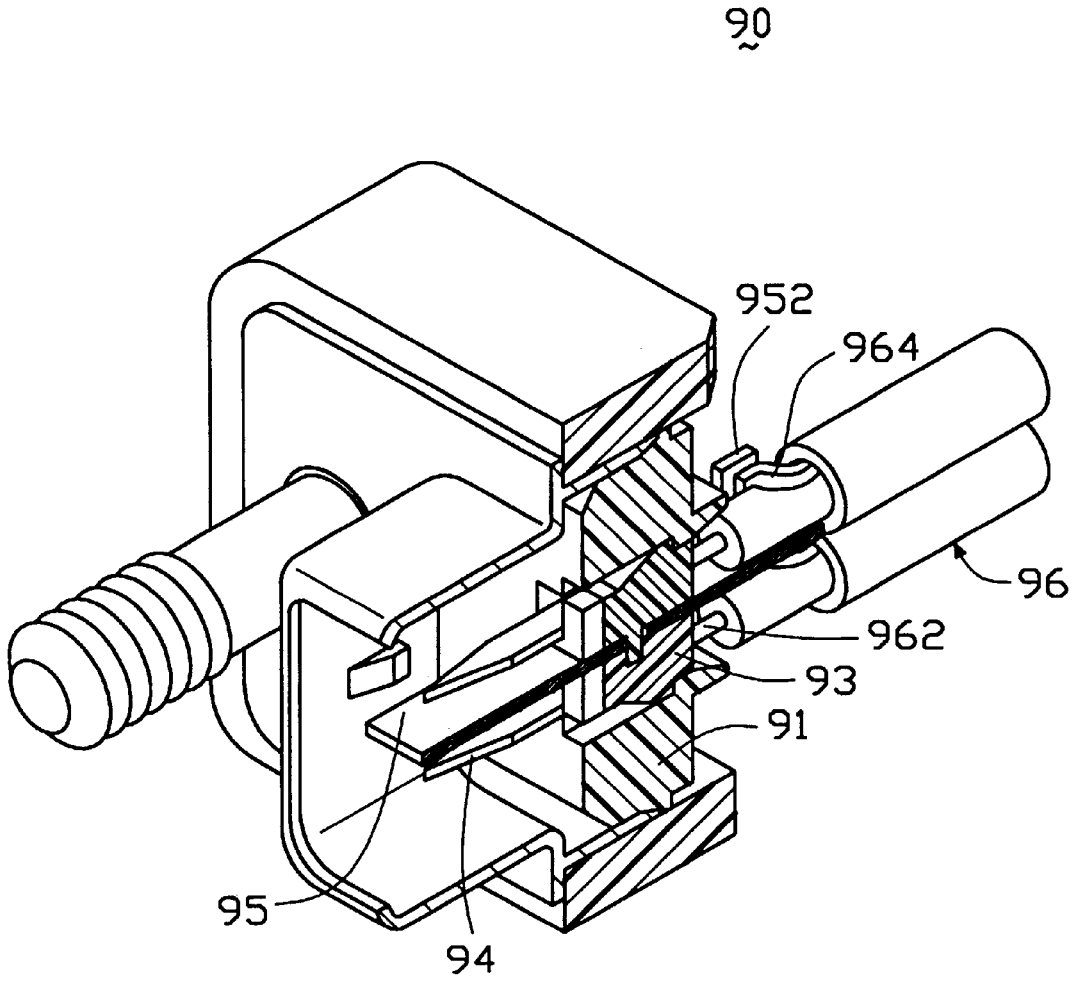
FIG. 5 (PRIOR ART)
FIG. 5 is a fragmental cross-sectional view of a conventional cable connector.

Referring to FIG. 1 and FIG. 4, a cable connector 100 of the present invention for terminating an electrical cable 20 and mating with a complementary connector (not shown) comprises a pair of cover-molded boots 21, a conductive shield 22 attached to a front face of the cover-molded boots 21, an insulative housing 10 received within the cover-molded boots 21, a plurality of data transmission terminals 24 received in the insulative housing 10, and a system for high-speed signal transmission 30 (see FIG. 2) assembled in the insulative housing 10.

The insulative housing 10 is rectangular and has a mating face 12 and a mounting face 13 opposite to the mating face 12. A cavity 14 is defined in one side of the mounting face 13 to accommodate the system for high-speed signal transmission 30. A plurality of terminal passageways (not shown) are defined through the insulative housing 10 from the mating face 12 to a front wall (not labelled) of the cavity 14. A pair of symmetrical channels 142 are defined in an upper and a lower side walls (not labelled) of the cavity 14 near the mounting face 13 in communication with a pair of recesses 144 at an end thereof. A hollow (not shown) is depressed from the mounting face 13 beside the cavity 14. A plurality of data terminal passageways (not shown) is defined in the insulative housing 10 from the mating face 12 to a front wall (not shown) of the hollow (not shown) for insertion of data transmission terminals 24 therethrough.

Figure 2:
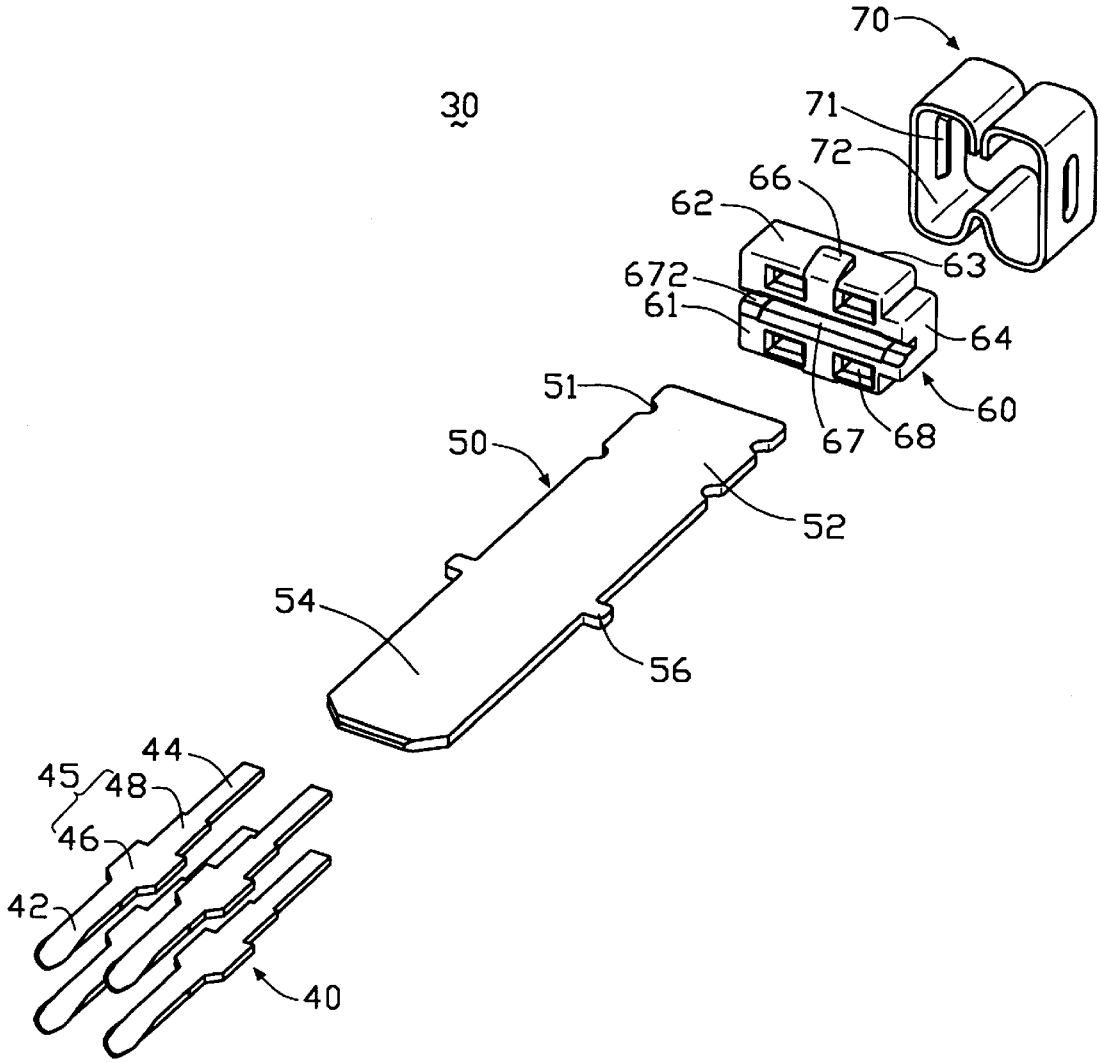
FIG. 2 is an exploded view of a system for high speed signal transmission of the cable connector of the present invention.

Referring to FIG. 2, the system for high-speed signal transmission 30 comprises a plurality of high-speed signal terminals 40, a grounding plate 50, an insulative spacer 60, and a ferrule 70.

Each high-speed signal terminal 40 has a distorted contact portion 42 at a front end, a solder portion 44 located at a rear end, and a fitting portion 45 between the contact portion 42 and the solder portion 44. The fitting portion 45 forms a widened portion 46 adjacent the contact portion 42 for fitting into the terminal passageway of the insulative housing 10, and a position portion 48 between the widened portion 46 and the solder portion 44 for fitting into the insulative spacer 60.

The elongate grounding plate 50 defines a blade portion 54 at a front end and a jointing portion 52 at a rear end, a pair of teeth 56 laterally projecting from two opposite side edges of the grounding plate 50. A pair of notches 51 is recessed from two opposite sides of the jointing portion 52.

The insulative spacer 60 is roughly a cube mountable to the grounding plate 50, and defines a front face 61, a top face 62, and a rear face 63, and forms a protrusion 64 projecting from a right side (not labelled). An elongate slot 67 extends through the insulative spacer 60 from the front face 61 to the rear face 63 thereof, and a pair of grooves 672 is defined in the front face 61 in communication with the slot 67. A plurality of passageways 68 is symmetrically defined through the insulative spacer 60 on opposite sides of the slot 67. A pair of tabs 66 projects from the top face 62 and a bottom face (not shown) opposite to the top face 62 for engaging with the insulative housing 10 (refer to FIG. 4).

The ferrule 70 is bent to a circularity from a single metal sheet, a gripping space 72 being formed within the ferrule 70 for gripping a plurality of metallic braids 84 of the coaxial cables 82 of the electrical cable 20 (refer to FIG. 4). A pair of ribs 71 is inwardly formed on opposite lateral sides of the ferrule 70.

Figure 3:
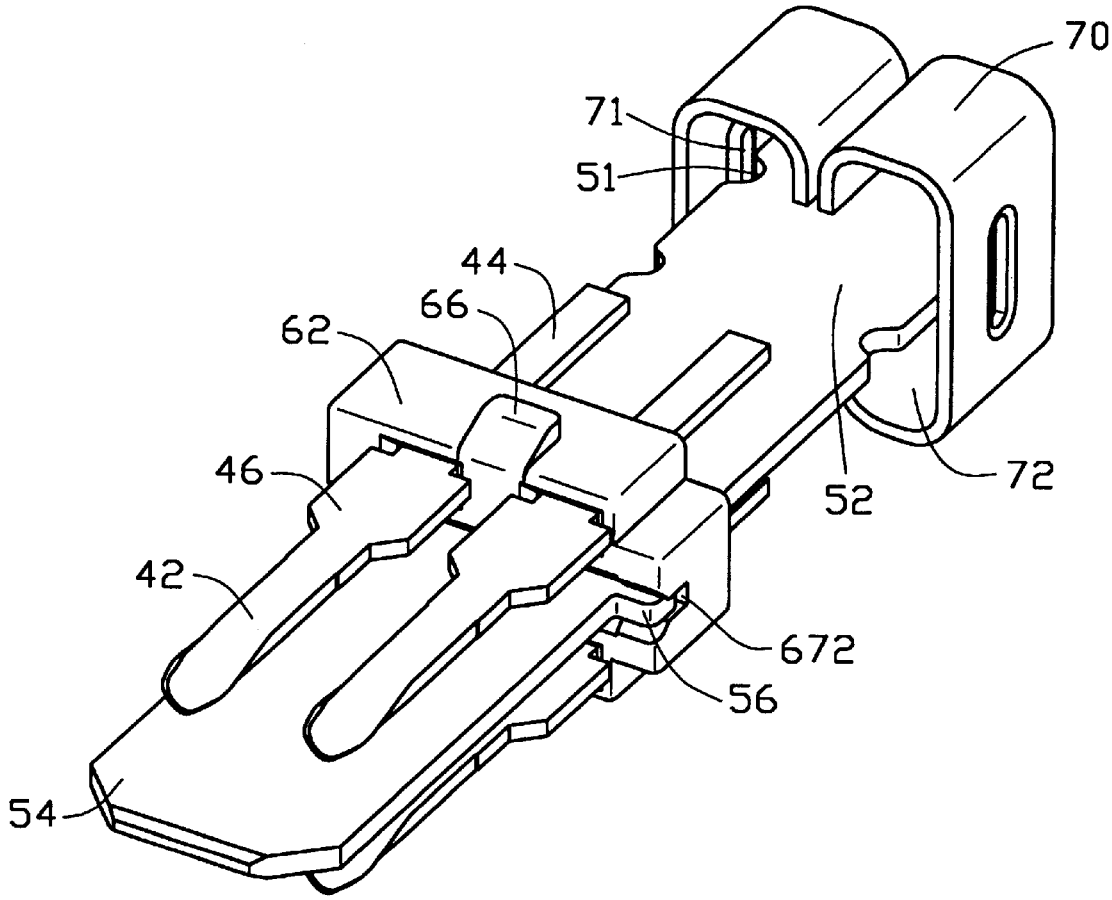
FIG. 3 is an assembled view of FIG. 2.

Referring to FIGS. 3 and 4, in assembly, the grounding plate 50 is first inserted through the slot 67 of the insulative spacer 60 from the front face 61 until the teeth 56 of the grounding plate 50 are stopped in the grooves 672 of the insulative spacer 60. The jointing portion 52 of the grounding plate 50 is inserted into the gripping space 72 of the ferrule 70 with the notches 51 being latchably engaged with the corresponding ribs 71 on the ferrule 70. Moreover, the front edge of the teeth 56 of the grounding plate 50 also abuts against a front portion of the housing 10 when the spacer 60 is assembled in the housing 10. Thus, the grounding plate 50 can be secured in position with regard to the housing 10.

The high-speed signal terminals 40 are fitted in the terminal passageways (not shown) of the insulative housing 10 by fitting the contact portions 42 into the passageways whereby the contact portions 42 extend from the mating face 12 and the widened portions 46 and the solder portions 44 are exposed in the cavity 14. The insulative spacer 60 is inserted in the cavity 14 of the insulative housing 10 with the tabs 66 of the insulative spacer 60 sliding through the channels 142 and into the recesses 144, the protrusion 64 engaging with the insulative housing 10. At the same time, the solder portions 44 of the signal terminals 40 are correspondingly inserted into the passageways 68 of the insulative spacer 60 from the front face 61, and then the position portions 48 of the signal terminals 40 are fitted into the passageways 68 and the widened portions 46 are sandwiched between the front face 61 of the insulative spacer 60 and the front wall of the cavity 14 of the housing 10 for retention (FIG. 4).

At the rear end of the grounding plate 50, coaxial cables 82 of the electrical cable 20 correspondingly extend into the gripping space 72 of the ferrule 70 while the center conductor 86 of each coaxial cable 82 of the electrical cable 20 is soldered to a solder portion 44 of a corresponding signal terminal 40. Metallic braids 84 shielding the coaxial cables 82 are clamped by the ferrule 70. An electrical connection is thus established from the metallic braids 84 through the ferrule 70 and to the grounding plate 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

an insulative housing having a mating face, a mounting face opposite to the mating face, a cavity defined in the mounting face, and a plurality of passageways through the mating face and in communication with the cavity;

a plurality of data terminals being received in the insulative housing;

a plurality of high-speed signal terminals each having a contact portion at a front end thereof and extending through a corresponding passageway of the insulative housing, a solder portion at a rear end thereof for terminating a center conductor of a coaxial cable, and a fitting portion between the contact portion and the solder portion;

a grounding plate having a front blade portion, a rear jointing portion, and a pair of teeth laterally projecting from two opposite side edges thereof;

an insulative spacer having a front face, a rear face opposite to the front face, an elongate slot extending through both faces for receiving the grounding plate, a pair of grooves recessed from the front face and in communication with the slot for receiving the teeth of the grounding plate, and a plurality of passageways on opposite sides of the slot for receiving the fitting portions of the signal terminals, the insulative spacer together with the grounding plate being securely insertable into the cavity to firmly clamp the signal terminals between the insulative spacer and the insulative housing; and a ferrule for clamping the metallic braid of the coaxial cable to the grounding plate;

wherein the fitting portion comprises a widened portion adjacent to the contact portion, and a position portion between the widened portion and the solder portion, the position portion being fitted in a corresponding passageway of the insulative spacer, and the widened portion being clamped between the insulative housing and the insulative spacer.

2. The cable connector as claimed in claim 1, wherein the insulative spacer defines a pair of tabs at a top face and a bottom face thereof, and the insulative housing defines a pair of channels with recesses at an upper and a lower side walls of the cavity for slidably receiving the tabs.

3. A cable connector assembly comprising:

an insulative housing defining therein a cavity behind a front wall thereof;

an insulative spacer retainably received within the cavity, a slot horizontally extending through a middle portion thereof, a plurality of passageways extending through the spacer on opposite sides of the slot;

a plurality of high-speed signal terminals respectively assembled into the corresponding passageways in a front-to-back direction; and a planar grounding plate assembled to the spacer in the same front-to-back direction, said grounding plate extending through said slot and out of both opposite faces of the spacer with a pair of teeth on two sides thereof, each tooth being respectively engaged with the spacer and a front portion of the housing for retaining the grounding plate in position within the housing without back-and-forth movement thereof.

4. The cable connector assembly as claimed in claim 3, wherein said planar grounding plate further includes notches in a rear portion thereof, and the cable connector assembly includes a ferrule, which fixedly crimps braids of an associated cable extending forward from a rear end of the connector, wherein the ferrule forms ribs thereon and said ribs of the ferrule can retainably engage the notches of the rear portion of the grounding plate.

* * * * *